US008690592B2

(12) United States Patent
Liang

(10) Patent No.: US 8,690,592 B2
(45) Date of Patent: Apr. 8, 2014

(54) STRUCTURE OF SECURITY AND PROTECTION FOR CONNECTION SOCKET

(76) Inventor: Yu-Tai Liang, New Taipei (TW)

( * ) Notice: Subject to any disclaimer, the term of this patent is extended or adjusted under 35 U.S.C. 154(b) by 26 days.

(21) Appl. No.: 13/616,117

(22) Filed: Sep. 14, 2012

(65) Prior Publication Data

US 2013/0330980 A1 Dec. 12, 2013

(30) Foreign Application Priority Data

Jun. 8, 2012 (TW) ..... 101211077 A

(51) Int. Cl.
*H01R 13/62* (2006.01)

(52) U.S. Cl.
USPC ..... 439/304

(58) Field of Classification Search
USPC ..... 439/304, 344, 354
See application file for complete search history.

(56) References Cited

U.S. PATENT DOCUMENTS

| | | | | |
|---|---|---|---|---|
| 6,120,311 | A * | 9/2000 | Wold et al. | 439/304 |
| 6,234,818 | B1 * | 5/2001 | Chun Te | 439/304 |
| 6,589,064 | B1 * | 7/2003 | Chen | 439/304 |
| 6,848,926 | B2 * | 2/2005 | Ling et al. | 439/304 |
| 6,890,197 | B2 * | 5/2005 | Liebenow | 439/188 |
| 7,108,564 | B2 * | 9/2006 | Liao | 439/676 |
| 7,361,047 | B2 * | 4/2008 | Strahl | 439/354 |
| 7,425,146 | B2 * | 9/2008 | Valentin | 439/304 |
| 7,462,045 | B1 * | 12/2008 | Lee | 439/133 |
| 7,540,756 | B1 * | 6/2009 | Strahl | 439/354 |
| 8,231,393 | B2 * | 7/2012 | Liang | 439/133 |
| 2006/0009083 | A1 * | 1/2006 | Liao | 439/676 |
| 2006/0084324 | A1 * | 4/2006 | Liao | 439/676 |

* cited by examiner

*Primary Examiner* — Neil Abrams
*Assistant Examiner* — Phuongchi T Nguyen
(74) *Attorney, Agent, or Firm* — Rosenberg, Klein & Lee

(57) ABSTRACT

A structure of security and protection for connection socket includes a connection socket, a connection block, a resilient member, and a security member. The connection socket forms a receiving space and a slide channel. The slide channel is located at one side of the receiving space. The connection block is coupled to a rear end of the connection socket and forms a positioning section. The resilient member includes at least one resilient engagement section and is arranged in the positioning section of the connection block. The security member has an end forming a bar section that forms at a rear side thereof a barb section. The barb section is coupled to the at least one resilient engagement section of the resilient member. The bar section has two ends extending rearward to connect to a plate section. The security member is received in the slide channel of the connection socket.

15 Claims, 15 Drawing Sheets

STRUCTURE OF SECURITY AND PROTECTION FOR CONNECTION SOCKET

FIELD OF THE INVENTION

The present invention relates to an improved structure of security and protection for connection socket, and in particular to a combined arrangement of a connection socket, a connection block, a resilient member, and a security member that realizes easy assembly, prevents a connected cable from loosening, prevents unauthorized connection of a connection cable to the connection socket, provides an effective protection against theft of connection cable, is durable, and is easy to practice, and is applicable to various types of security and protection structure of connection socket or the likes.

BACKGROUND OF THE INVENTION

It is a common practice to embed telephone lines, network lines, and power lines in a building structure. It is a particularly commonly practiced way of construction to embed various lines and cables in the building structure, such as an office building, a business building, and a hotel. These lines and cables are coupled to connection sockets that are embedded in walls or floors of a building for both easy use and aesthetic appearance.

To use, a user may plug a device into a corresponding one of the connection sockets, according to the nature of the device to be used. For example, to connect to the Internet, a connection cable is used to connect between a networking device and the Internet. Hotels that provide Internet connection service usually provide a connection cable to a hotel resident to allow the hotel resident to connect personal networking devices for Internet connection during the period of staying in the hotel. However, the network connection cables or telephones cables that are currently available in the market are plug-and-play cables. This makes it easy to connect and remove the cables, but it also suffers easy loosening, being stolen, and getting lost easily.

In view of these problems, the present invention aims to provide a structure of security and protection for connection socket that has a simple structure, provides effective protection against theft, prevents unauthorized connection, and is easy to practice in order to overcome the problems of the conventional connection socket that provides generally no means for protection against theft and unauthorized connection.

SUMMARY OF THE INVENTION

An object of the present invention is to provide an improved structure of security and protection for connection socket, which comprises a combined arrangement of a connection socket, a connection block, a resilient member, and a security member that realizes easy assembly of the structure of security and protection for connection socket, prevents unauthorized connection, provides an effective protection against theft, is durable, and is easy to practice, so as to achieve utility, improvement, and convenience of the present invention.

To achieve the above object, the present invention provides a structure of security and protection for connection socket, which comprises a connection socket, a connection block, a resilient member, and a security member. The connection socket forms a receiving space and a slide channel. The slide channel is located at one side of the receiving space. The connection block is coupled to a rear end of the connection socket and the connection block forms a positioning section. The resilient member comprises at least one resilient engagement section. The resilient member is arranged in the positioning section of the connection block. The security member has an end forming a bar section. The bar section forms at a rear side thereof a barb section. The barb section is coupled to the at least one resilient engagement section of the resilient member. The bar section of the security member has two ends extending rearward to connect to a plate section. The security member is received in the slide channel of the connection socket. As such, advantages of being easy to assembly, prohibiting connection cable from getting loosened, preventing unauthorized connection of a connection cable to the connection socket, providing effective protection against theft, being durable, and being easy to practice so that the overall utility, safety, and convenience are improved.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
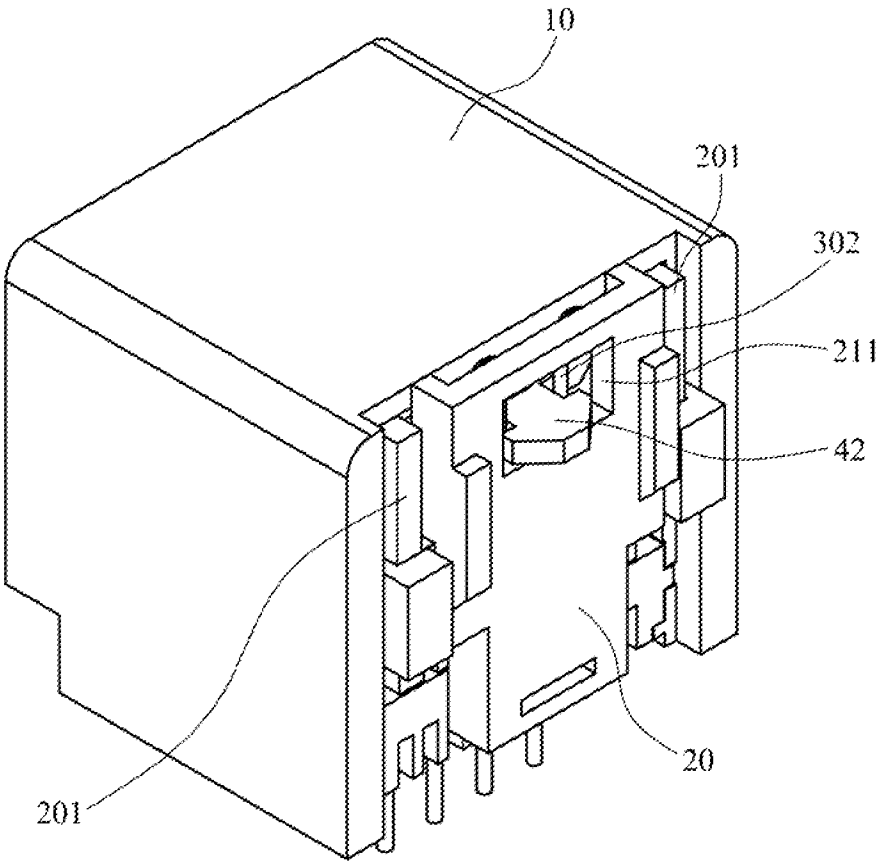
FIG. 1 is a perspective view showing first embodiment of present invention.
Figure 2:
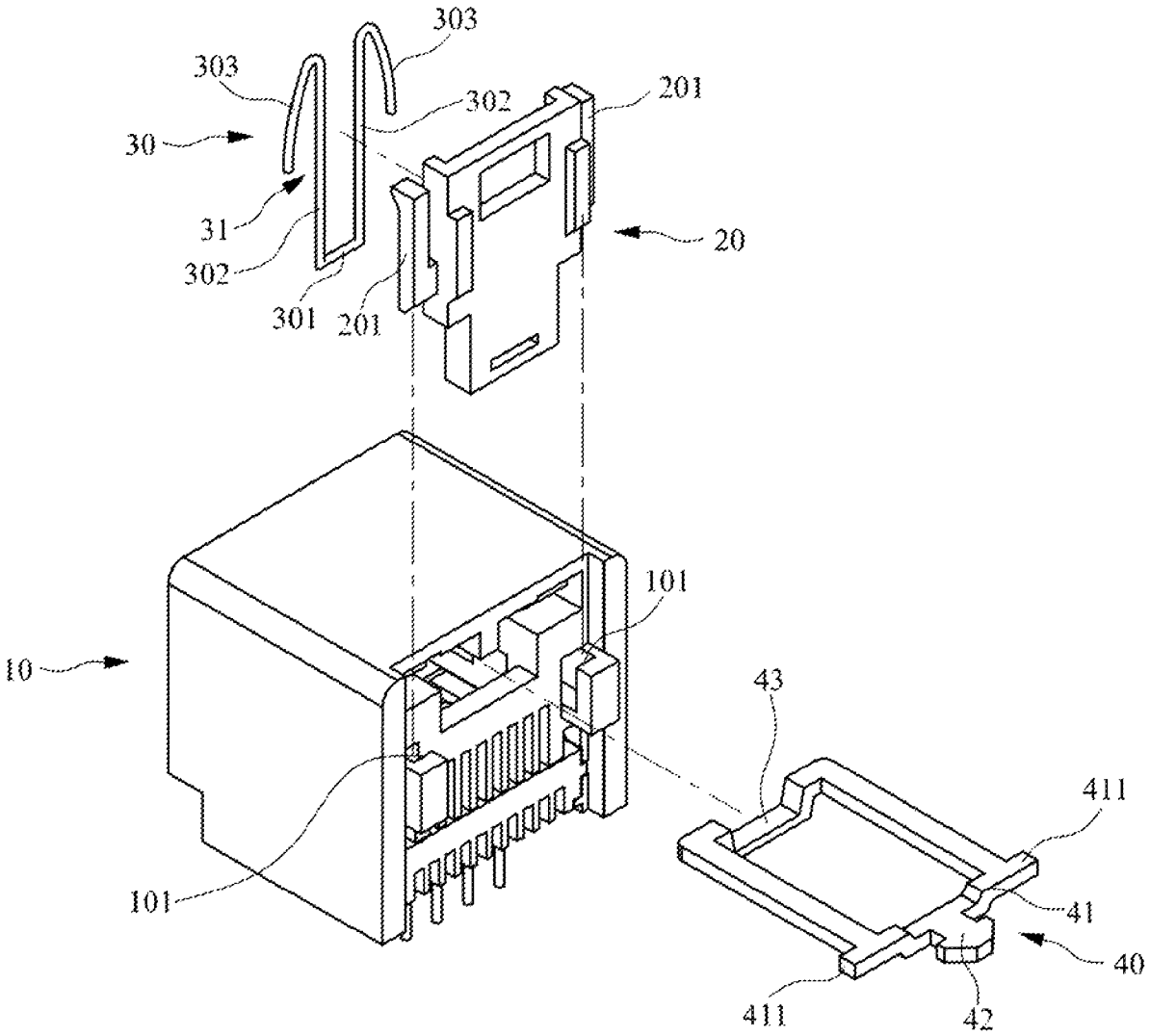
FIG. 2 is an exploded view of the first embodiment of the present invention.
Figure 3:
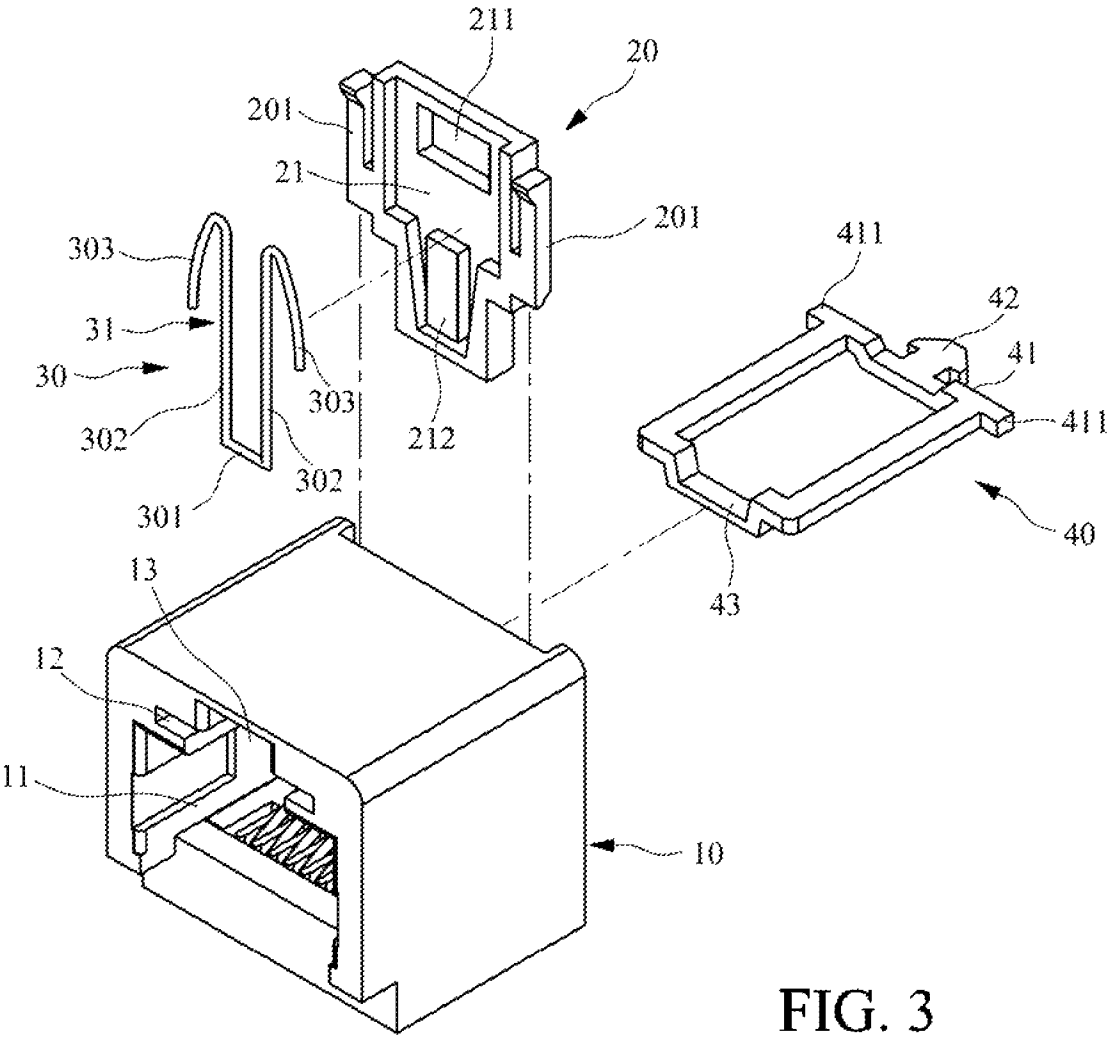
FIG. 3 is also an exploded view of the first embodiment of the present invention taken at a different perspective.
Figure 4:
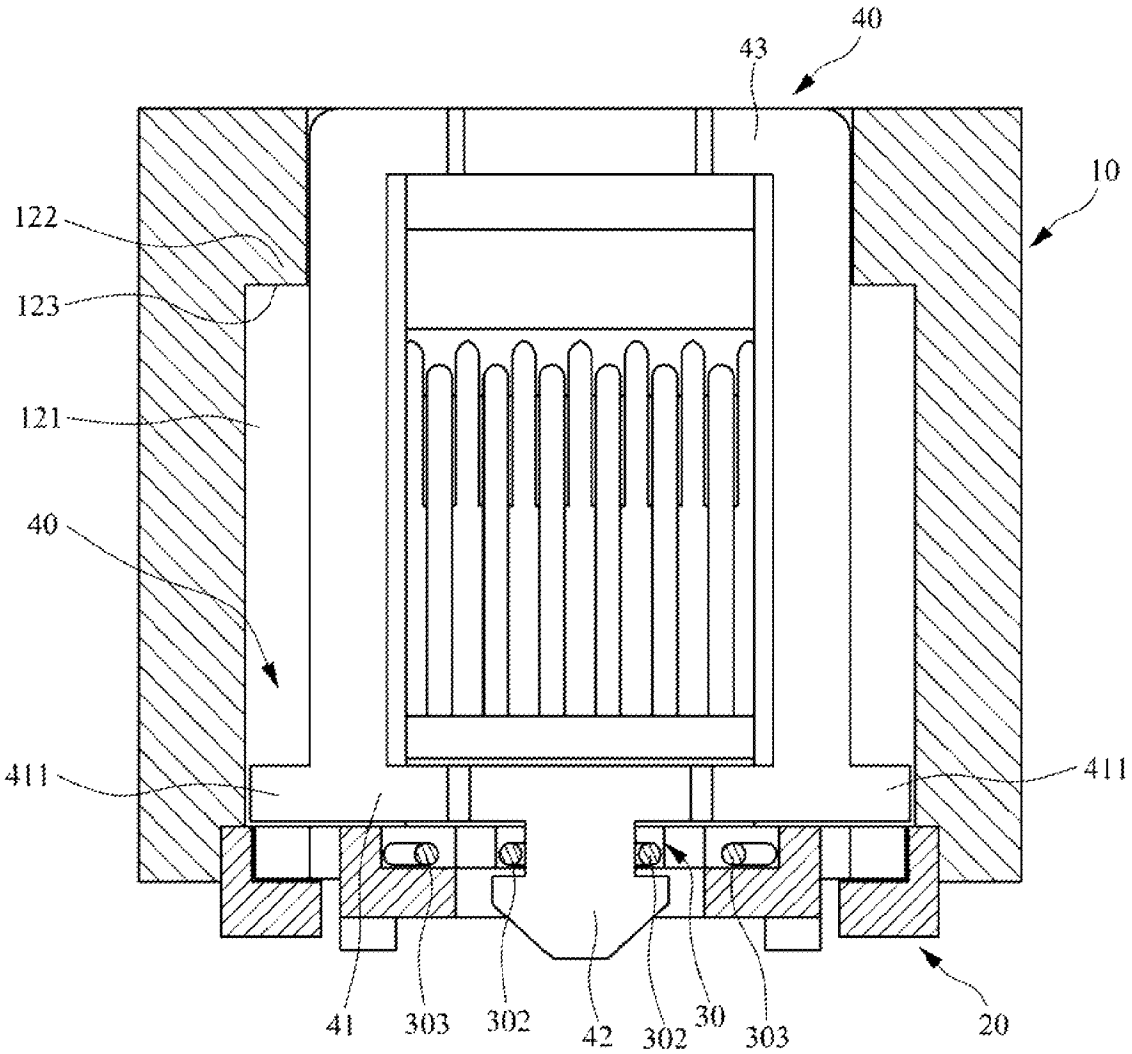
FIG. 4 is a cross-sectional view of the first embodiment of the present invention in an assembled form.
Figure 5:
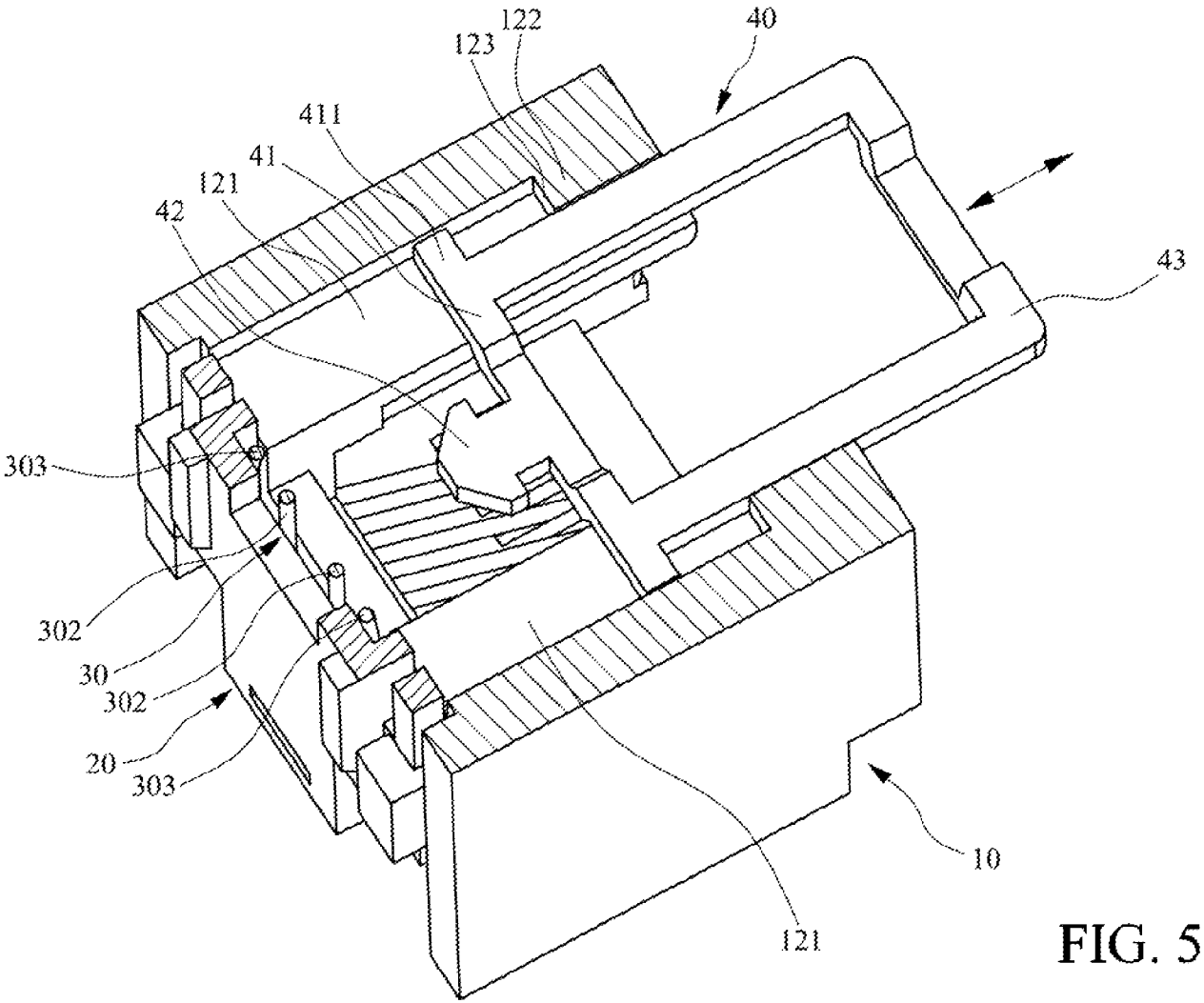
FIG. 5 is a perspective view, partially broken, showing position constraining of a security member of the first embodiment of the present invention.
Figure 6:
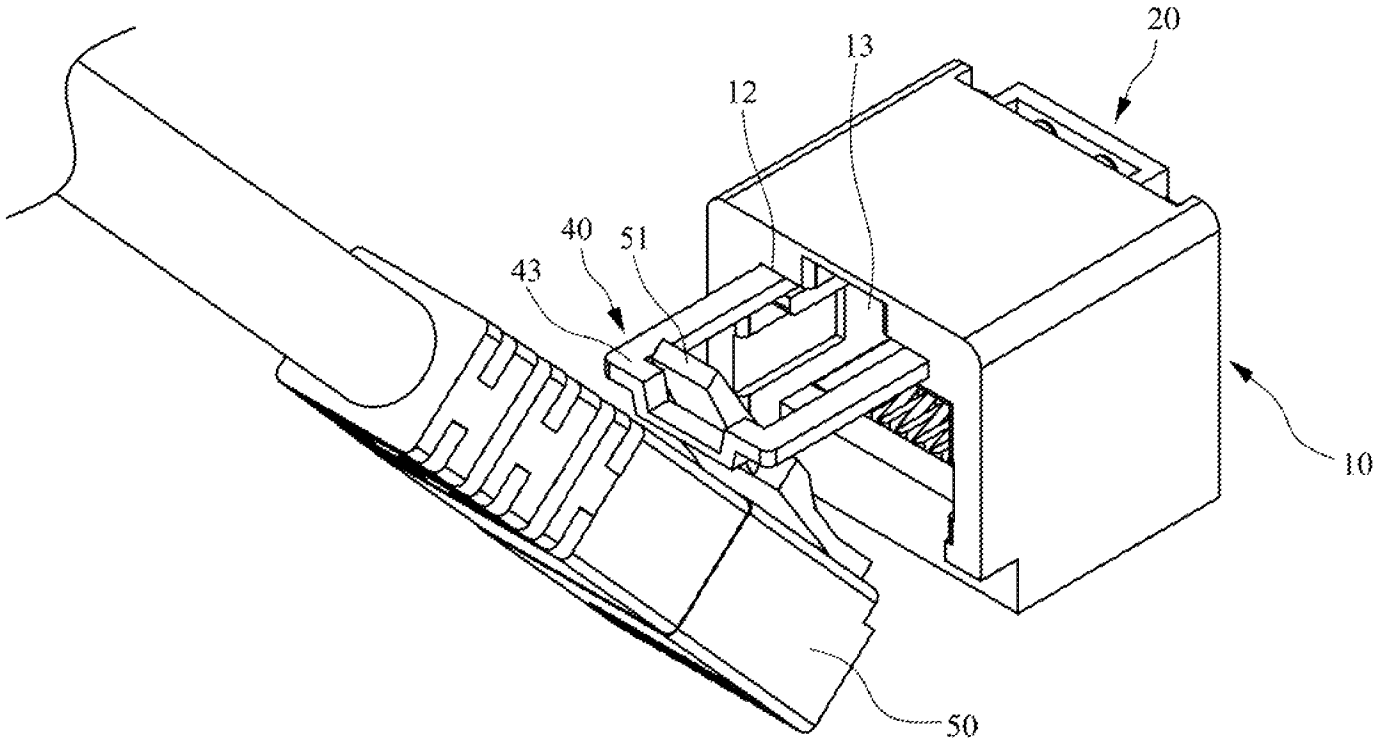
FIG. 6 is a perspective view illustrating an operation of using the first embodiment of the present invention.
Figure 7:
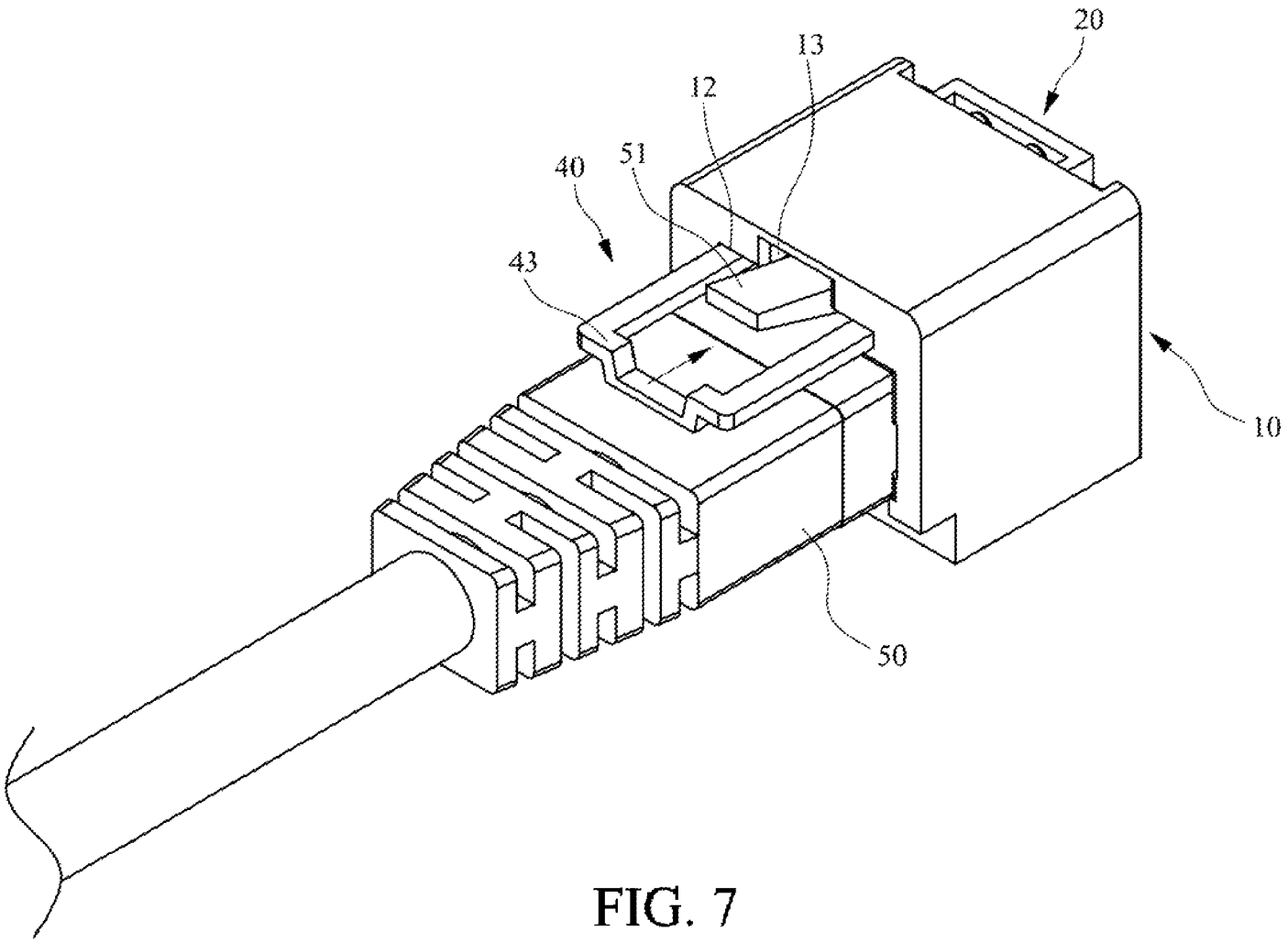
FIG. 7 is a perspective vie showing the first embodiment of the present invention in a use condition.
Figure 8:
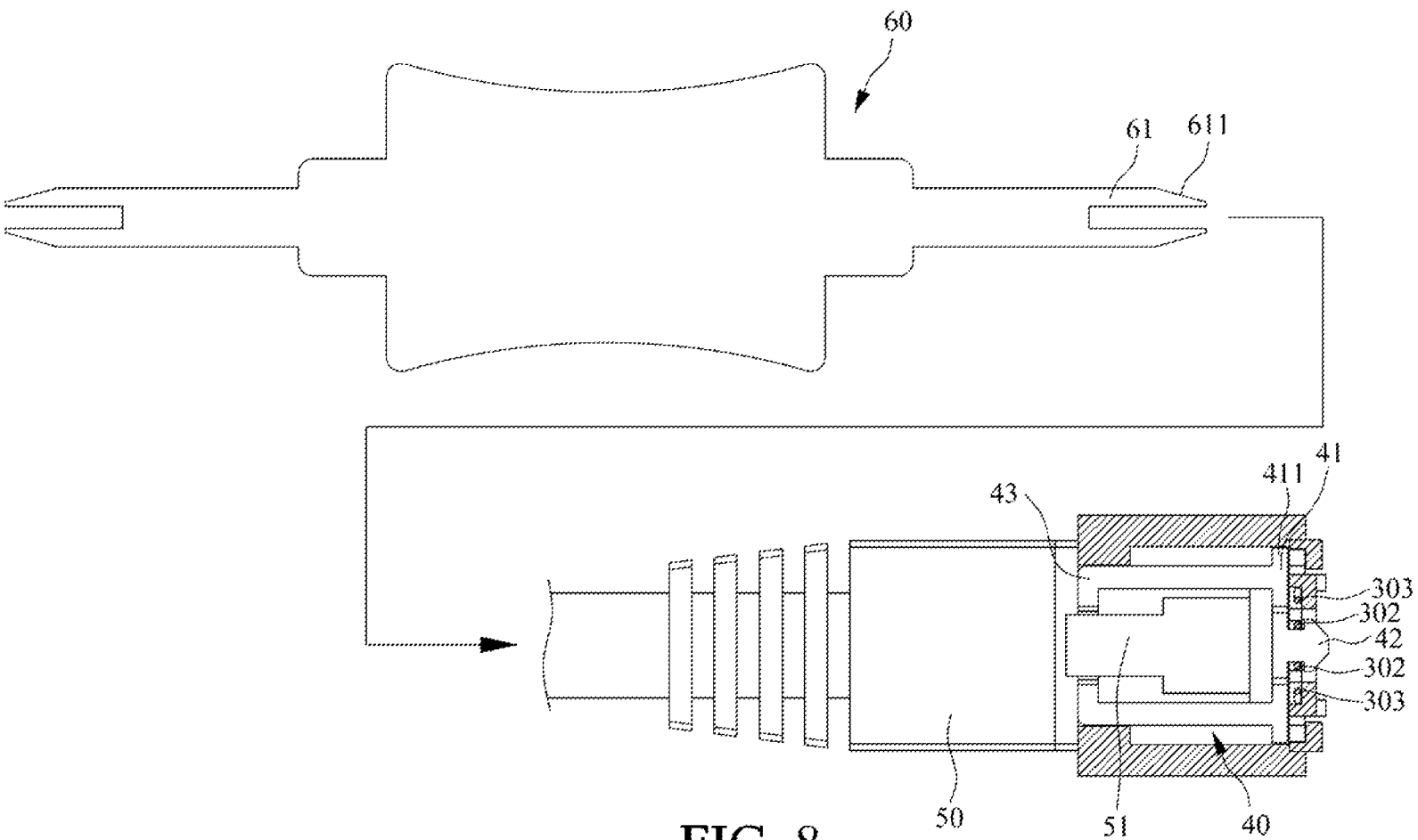
FIG. 8 is a schematic view illustrating a release operation of the first embodiment of the present invention.
Figure 9:
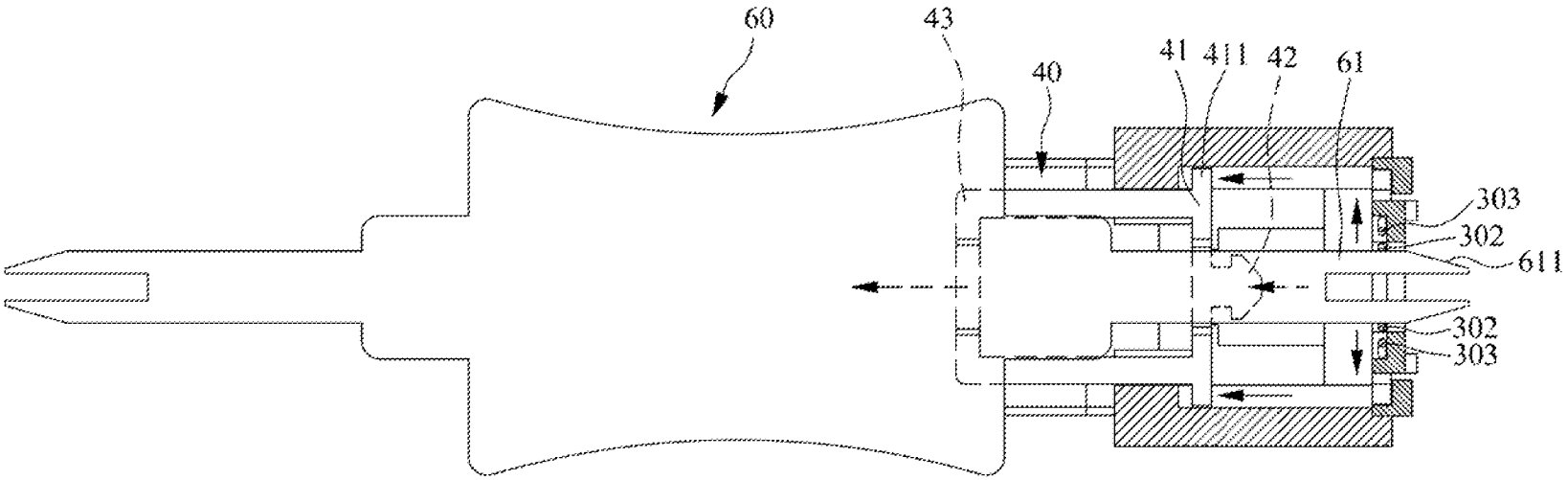
FIG. 9 is a cross-sectional view illustrating the releasing operation of the first embodiment of the present invention.

With reference to the drawings and in particular to FIGS. 1-9 (first embodiment), the present invention provides an improved structure of security and protection for connection socket, which will be referred as connection socket security and protection structure hereinafter. The connection socket security and protection structure comprises a connection socket 10 and the connection socket 10 forms a receiving space 11 and a slide channel 12. The slide channel 12 is located at one side of the receiving space 11. A penetration hole 13 is formed in the connection socket 10 immediately adjacent to and above the slide channel 12.

A connection block 20 is coupled to a rear end of the connection socket 10. The connection block 20 forms a positioning section 21.

A resilient member 30 comprises at least one resilient engagement section 31. The resilient member 30 is arranged in the positioning section 21 of the connection block 20. The resilient member 30 is made of a metallic material or other resilient materials.

A security member 40 has an end forming a bar section 41. The bar section 41 forms at a rear side thereof a barb section 42. The barb section 42 is coupled to at least one resilient engagement section 31 of the resilient member 30. The bar section 41 of the security member 40 has two ends extending rearward to connect to a plate section 43. The security member 40 is received in the slide channel 12 of the connection socket 10. The bar section 41 and the plate section 43 of the security member 40 are integrally formed to show a frame-like configuration.

The positioning section 21 of the connection block 20 is a recess. The resilient member 30 comprises a connection section 301. The connection section 301 has two ends from which retention sections 302 respectively and perpendicularly extend so that the retention sections 302 each have an end forming a bent section 303 to thereby form two opposite resilient engagement sections 31. The bent sections 303 of the resilient member 30 are resiliently engageable with and thus retained by inside surface of the recess of the connection block 20. The barb section 42 of the security member 40 is received and retained between the retention sections 302 of the two resilient engagement sections 31. A through hole 211 is formed in the recess of the connection block 20 to receive the barb section 42 of the security member 40 therein. A raised portion 212 is formed in the recess of the connection block 20 to retain and constrain the resilient member 30.

Further, the slide channel 12 comprises two sliding grooves 121 forming in two sides thereof. Each of the sliding grooves 121 is arranged to extend in the extension direction of the slide channel 12 and each of the sliding grooves 121 comprises therein a guide block 122. The guide block 122 has an inner side forming a constraining face 123. The bar section 41 formed at one end of the security member 40 forms at the two ends thereof stop blocks 411. When the security member 40 is moved in the extension direction of the slide channel 12, the stop blocks 411 on the two ends of the bar section 41 are brought into engagement with the constraining faces 123 of the guide blocks 122 of the connection socket 10 to stop further movement of the security member 40. Further, the rear end of the connection socket 10 forms, at two side portions thereof, two insertion slots 101. Two sides of the connection block 20 are provided with two side posts 201 corresponding to the insertion slots so as to allow the connection block 20 to be coupled to the rear end of the connection socket 10.

Figure 10:
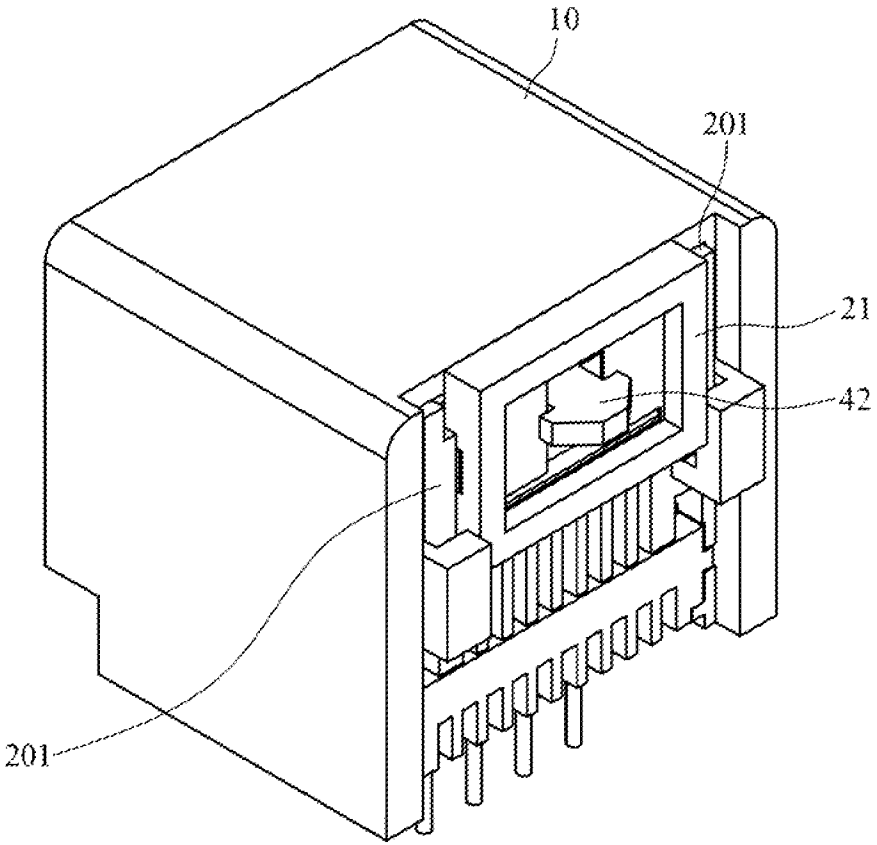
FIG. 10 is a perspective view showing a second embodiment of the present invention.
Figure 11:
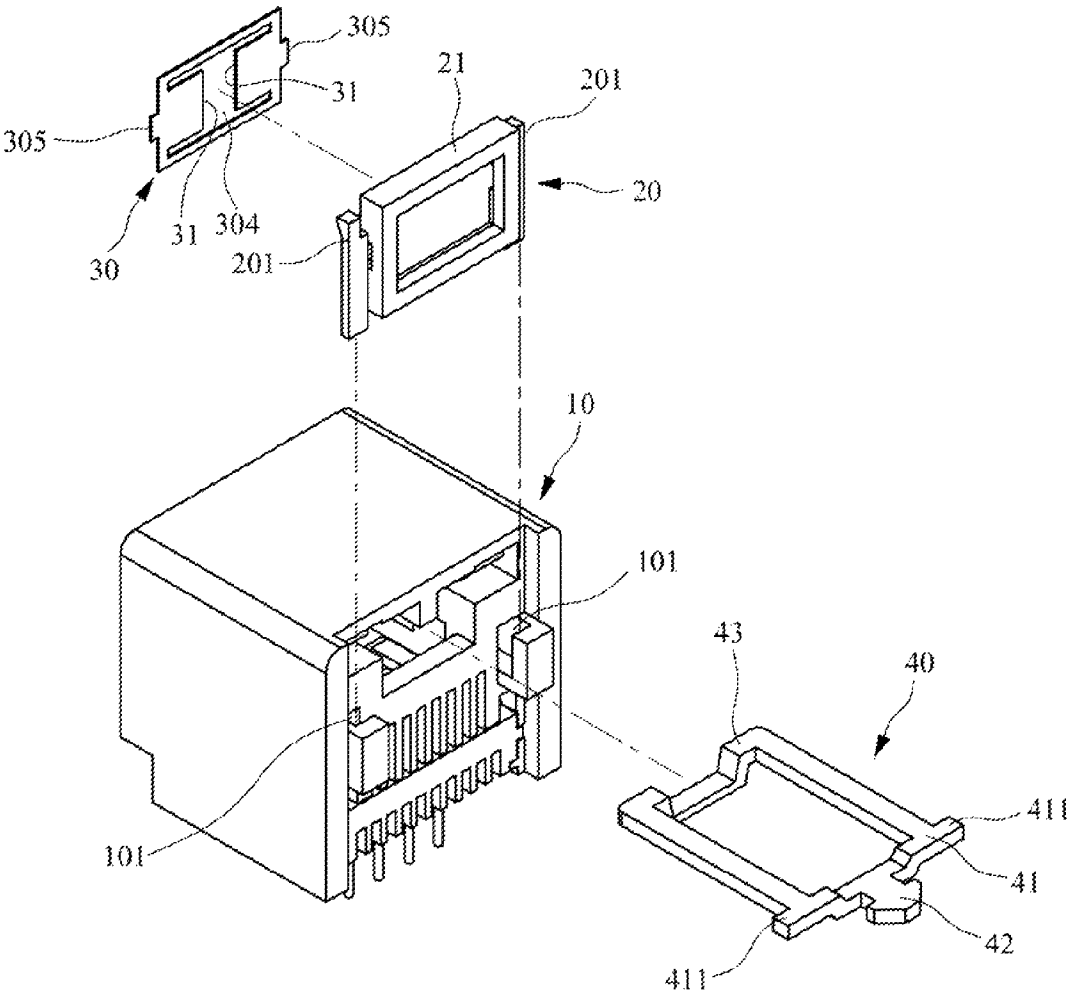
FIG. 11 is an exploded view of the second embodiment of the present invention.
Figure 12:
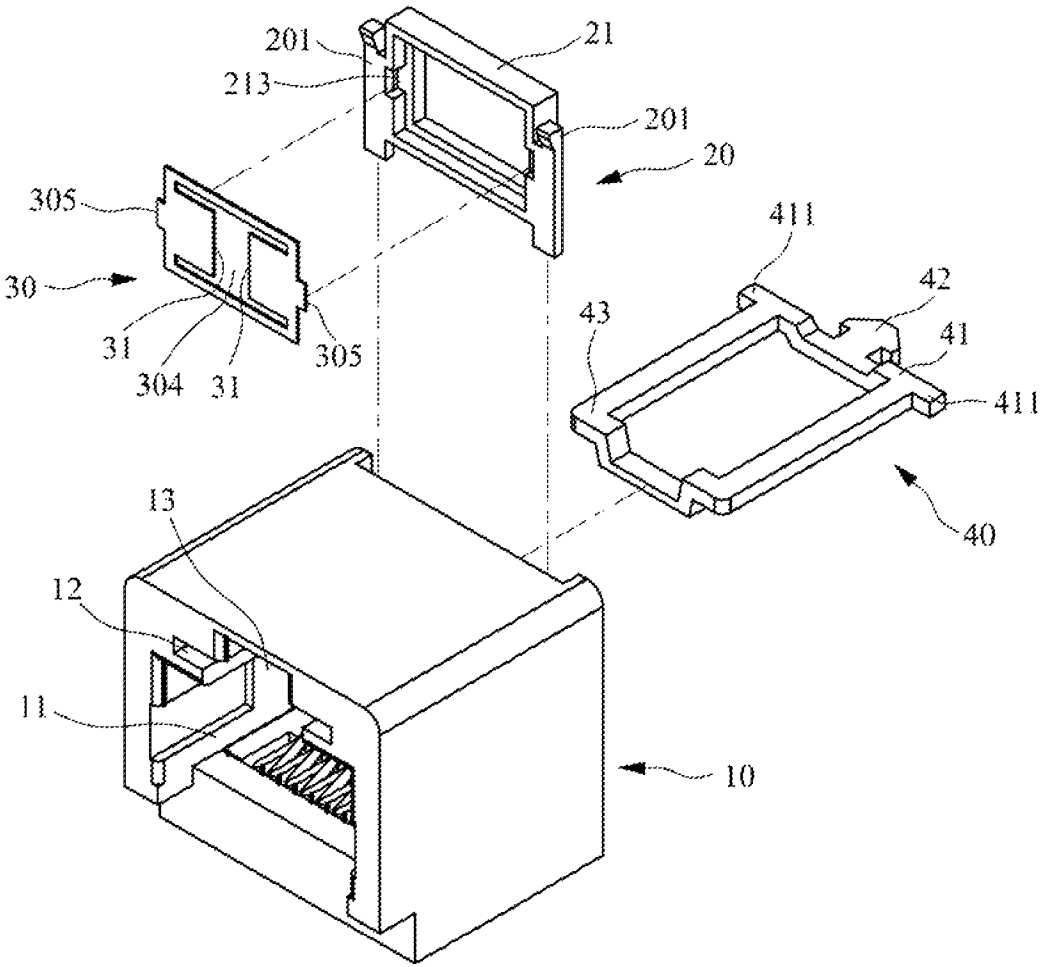
FIG. 12 is also an exploded view of the second embodiment of the present invention taken at a different perspective.
Figure 13:
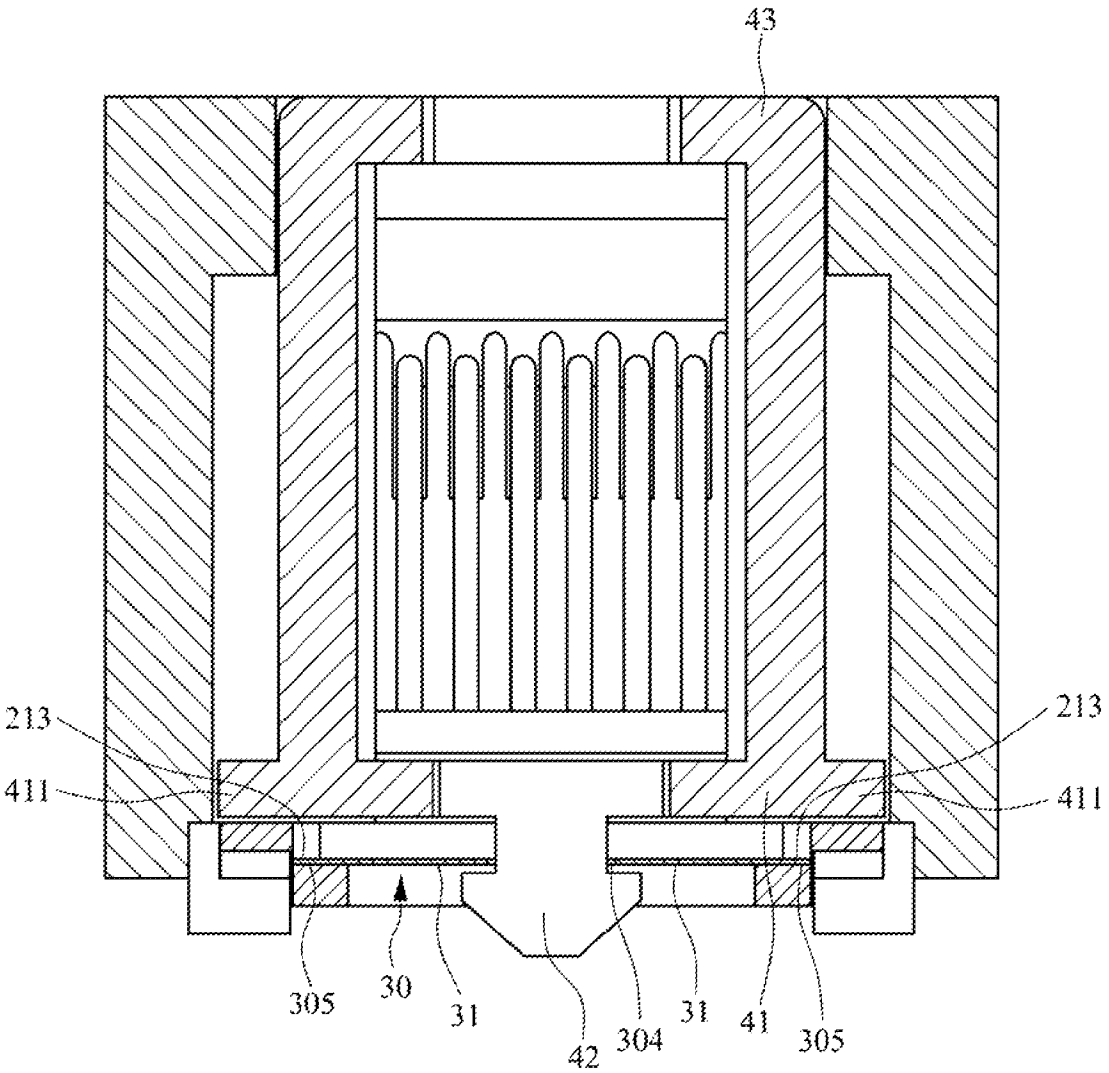
FIG. 13 is a cross-sectional view of the second embodiment of the present invention in an assembled form.

Referring to FIG. 1-13, in a practical application of the present invention, the positioning section 21 of the connection block 20 can be alternatively made in the form of a frame (see FIGS. 10-13, which illustrate a second embodiment) and the resilient member 30 is made in the form of a plate, whereby the plate is received in and coupled to the frame. The plate forms an l-shaped opening 304 and two opposite sides of the l-shaped opening 304 form two opposite resilient engagement sections 31 so that the barb section 42 of the security member 40 is receivable and retained between the two resilient engagement sections 31. The frame of the connection block 20 has two opposite inside walls that form recesses 213 and the plate has two opposite ends forming corresponding projections 305 for coupling the plate and the frame together. Other components/parts are identical to what described above and further description will omitted.

With above structure, an improved structure of security and protection for connection socket is formed. As shown in FIGS. 1-13, the features of the present invention are that a combined arrangement of a connection socket 10, a connection block 20, a resilient member 30, and a security member 40 is provided in such a way that the connection block 20 is coupled to a rear end of the connection socket 10. The resilient member 30 comprises at least one resilient engagement section 31 and the resilient member 30 is arranged inside a positioning section 21 of the connection block 20. The security member 40 has an end forming a bar section 41 with a barb section 42 formed in a rear end of the bar section 41 so that the barb section 42 is engageable with and thus coupled to the at least one resilient engagement section 31 of the resilient member 30. The bar section 41 of the security member 40 has opposite ends extending rearward to connect to a plate section 43, and the security member 40 is received in a slide channel 12 of the connection socket 10 in such a way that the plate section 43 of the security member 40, when moved to a front end of the connection socket 10 (see FIGS. 6 and 7), can be coupled to a tongue 51 of a plug 50 of a network cable and the security member 40 is allowed to move back inward into the slide channel 12 of the connection socket 10 until the barb section 42 of the security member 40 engage the at least one resilient engagement section 31 of the resilient member 30 that is arranged inside the positioning section 21 of the connection block 20. Then, the at least one resilient engagement section 31 of the resilient member 30 will be expanded first. When the barb section 42 passes over the at least one resilient engagement section 31 of the resilient member 30, the at least one resilient engagement section 31 of the resilient member 30 will be returned to the original position by the resilience thereof. Under this condition, the barb section 42 of the security member 40 is coupled to the at least one resilient engagement section 31 of the resilient member 30. (In the first embodiment, the barb section 42 of the security member 40 first contacts the at least one resilient engagement section 31 of the resilient member 30 (namely the retention sections 302) that is arranged in the positioning section 21 of the connection block 20 to push away the two retention sections 302 of the resilient member 30. When the barb section 42 passes over the two retention sections 302 of the resilient member 30, the bent sections 303 extending from the ends of the resilient member 30 are driven by the resiliency thereof to return to the original position and at the same time cause the two retention sections 302 to return to the original positions. Under this condition, the barb section 42 of the security member 40 is coupled to the two retention sections 302 of the resilient member 30. In the second embodiment, the barb section 42 of the security member 40 first contact at least one resilient engagement section 31 of the resilient member 30 (namely the two resilient engagement sections 31 formed on two opposite sides of the l-shaped opening 304 formed in the plate) received in the positioning section 21 of the connection block 20. The two resilient engagement sections 31 of the resilient member 30 are thus pushed away. When the barb section 42 passes over the two resilient engagement sections 31 of the resilient member 30, the two resilient engagement sections 31 of the resilient member 30 are driven by the resiliency thereof to return to the original position. Under this condition, the barb section 42 of the security member 40 is coupled to the two resilient engagement sections 31 of the resilient member 3.) In this way, the plug 50 of a network cable is secured inside the connection socket 10 so that unauthorized plugging and theft can be effectively prohibited. Further, the resilient member 30 can be made of a metallic material or other resilient material, making the durability greatly improved. Further, to remove the plug 50 of the network cable (see FIGS. 7-9), a separation piece 60 can be used for quick release. The separation piece 60 forms, in an end thereof, a U-shaped tip section 61. The U-shaped tip section 61 has a front end of which two sides thereof form inclined guide sections 611. To release, the U-shaped tip section 61 of the separation piece 60 is inserted through the penetration hole 13 of the connection socket 10 that is located above the slide channel 12. The inclined guide sections 611 formed at two sides of the front end of the U-shaped tip section 61 are conducted into and gradually expand the at least one resilient engagement section 31 of the resilient member 30 (namely the two retention sections 302). With such an operation, the barb section 42 of the security member 40 is disengageable from the two retention sections 302 of the resilient member 30, allowing the security member 40 to move forward a distance in front of the connection socket 10 (in which when the security member 40 moves in the extension direction of the slide channel 12, the stop blocks 411 on the two ends of the bar section 41 are brought into engagement with the constraining faces 123 of the guide blocks 122 of the connection socket 10 to stop further movement of the security member 40), so that the tongue 51 of the plug 50 of the network cable is released from the security member 40. This makes the present invention easy to assembly and prohibits the connection cable from getting loosened, prevents unauthorized connection of a connection cable to the connection socket, provides effective protection against theft, being durable, and easy to practice. As such, the overall utility, safety, and convenience are improved.

Figure 14:
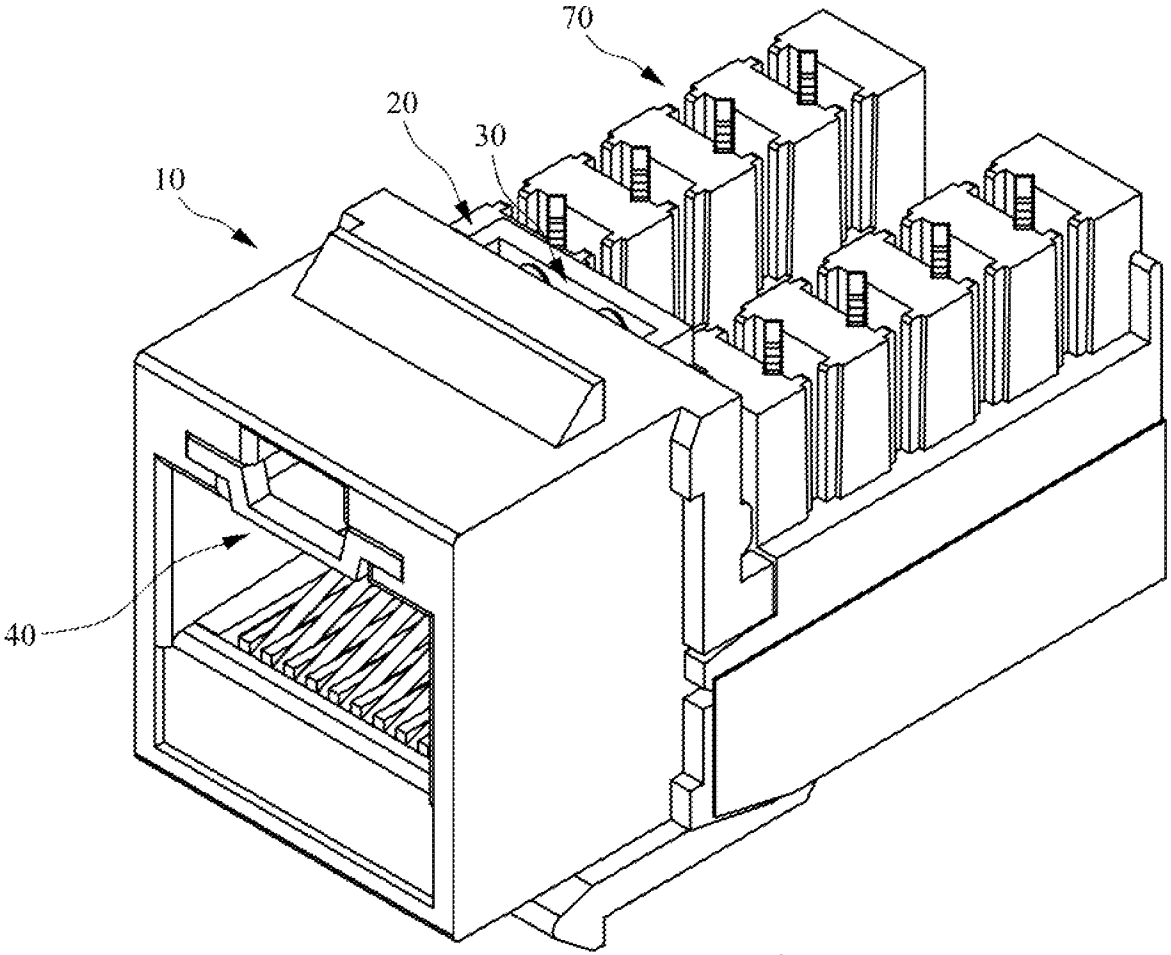
FIG. 14 is a perspective view showing a third embodiment of the present invention.
Figure 15:
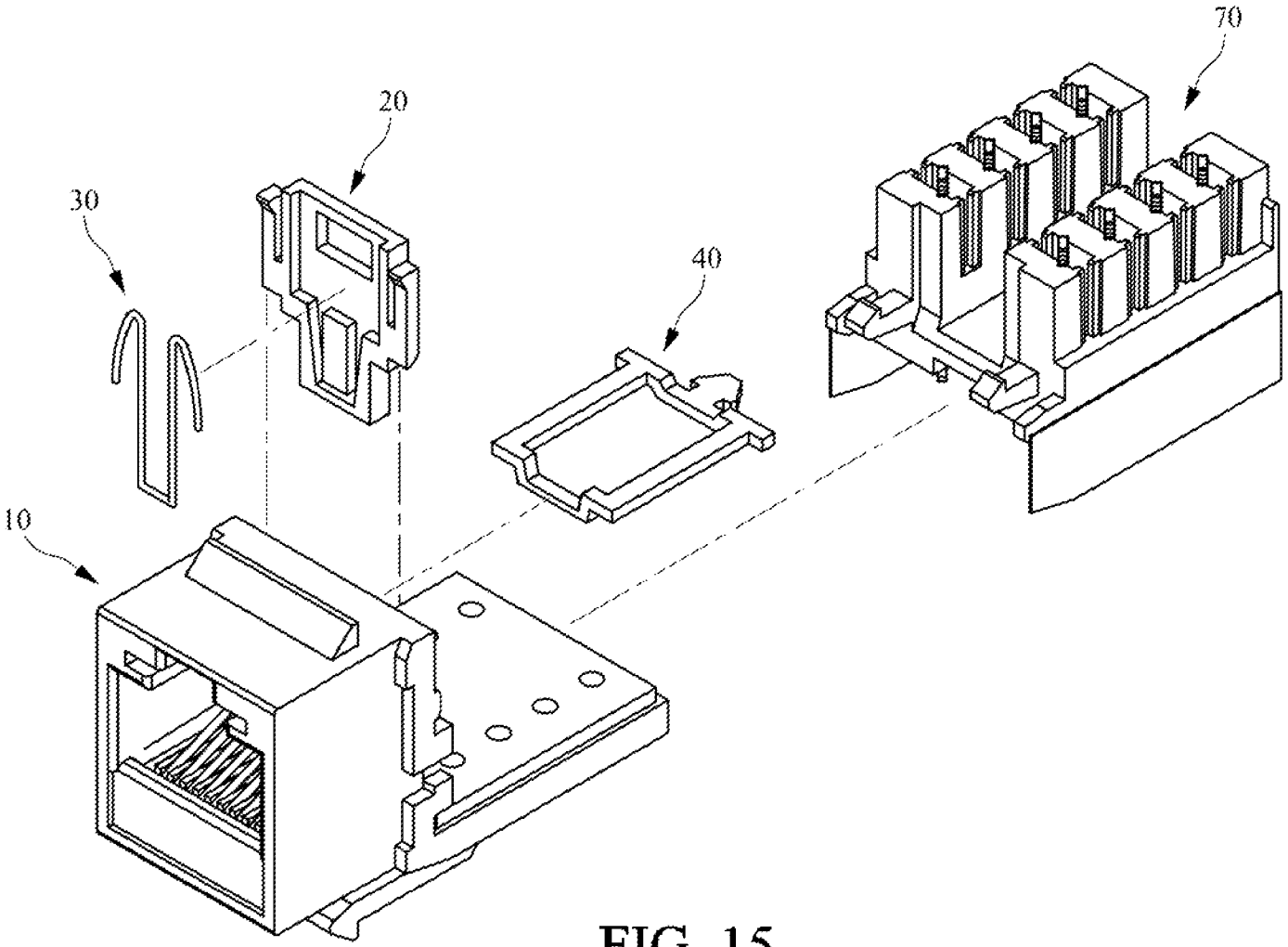
FIG. 15 is an exploded view of the third embodiment of the present invention.

Further, in a practical application, the connection socket 10 can be made as a fixed connection socket a retractable connection socket, or other similar connection socket (see FIGS. 1, 10, 14, and 15 ▩, which respectively illustrate the first, second, and third embodiments, of which components/parts of the second and third embodiments that are similar to those of the first embodiment will not be repeatedly described and in the third embodiment, besides a connection socket 10, a connection block 20, a resilient member 30, and a security member 40, a terminal holder 70 is further included and arranged at the rear end of the connection block 20).

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A structure of security and protection for connection socket, comprising a connection socket, the connection socket forming a receiving space and a slide channel, the slide channel being located at one side of the receiving space, a connection block coupled to a rear end of the connection socket, the connection block forming a positioning section;

a resilient member, which comprises at least one resilient engagement section, the resilient member being arranged in the positioning section of the connection block, a security member having an end forming a bar section, the bar section forming at a rear side thereof a barb section, the barb section being coupled to the at least one resilient engagement section of the resilient member, the bar section of the security member having two ends extending rearward to connect to a plate section, the security member being received in the slide channel of the connection socket.

2. The structure of security and protection for connection socket as claimed in claim 1, wherein the connection socket is a fixed connection socket.

3. The structure of security and protection for connection socket as claimed in claim 1, wherein the connection socket is a retractable connection socket.

4. The structure of security and protection for connection socket as claimed in claim 1, wherein the rear end of the connection socket forms, at two side portions thereof, two insertion slots, two sides of the connection block being provided with two side posts corresponding to the insertion slots so as to allow the connection block to be coupled to the rear end of the connection socket.

5. The structure of security and protection for connection socket as claimed in claim 1, wherein a penetration hole is formed in the connection socket immediately adjacent to and above the slide channel.

6. The structure of security and protection for connection socket as claimed in claim 1, wherein the slide channel comprises two sliding grooves forming in two sides thereof, each of the sliding grooves being arranged to extend in an extension direction of the slide channel, each of the sliding grooves comprising therein a guide block that has an inner side forming a constraining face, the bar section formed at one end of the security member forming at two ends thereof stop blocks, whereby when the security member is moved in the extension direction of the slide channel, the stop blocks on the two ends of the bar section are brought into engagement with the constraining faces of the guide blocks of the connection socket to stop further movement of the security member.

7. The structure of security and protection for connection socket as claimed in claim 6, wherein the bar section and the plate section of the security member are integrally formed to show a frame-like configuration.

8. The structure of security and protection for connection socket as claimed in claim 1, wherein the positioning section of the connection block comprises a frame and the resilient member comprises a plate, whereby the plate is received in and coupled to the frame, the plate forming an l-shaped opening, two opposite sides of the l-shaped opening forming two opposite resilient engagement sections, so that the barb section of the security member is receivable and retained between the two resilient engagement sections.

9. The structure of security and protection for connection socket as claimed in claim 8, wherein the frame of the connection block has two opposite inside walls that form recesses and the plate has two opposite ends forming corresponding projections for coupling the plate and the frame together.

10. The structure of security and protection for connection socket as claimed in claim 8, wherein the rear end of the connection socket forms, at two side portions thereof, two insertion slots, two sides of the connection block being provided with two side posts corresponding to the insertion slots so as to allow the connection block to be coupled to the rear end of the connection socket.

11. The structure of security and protection for connection socket as claimed in claim 1, wherein the positioning section of the connection block comprises a recess, the resilient member comprising a connection section that has two ends from which retention sections respectively and perpendicularly extend so that the retention sections each have an end forming a bent section to thereby form two opposite resilient engagement sections, the bent sections of the resilient member being resiliently engageable with and thus retained by inside surface of the recess of the connection block, the barb section of the security member being received and retained between the retention sections of the two resilient engagement sections.

12. The structure of security and protection for connection socket as claimed in claim 11, wherein a raised portion is formed in the recess of the connection block to retain and constrain the resilient member.

13. The structure of security and protection for connection socket as claimed in claim 11, wherein the rear end of the connection socket forms, at two side portions thereof, two insertion slots, two sides of the connection block being provided with two side posts corresponding to the insertion slots so as to allow the connection block to be coupled to the rear end of the connection socket.

14. The structure of security and protection for connection socket as claimed in claim 11, wherein a through hole is formed in the recess of the connection block to receive the barb section of the security member therein.

15. The structure of security and protection for connection socket as claimed in claim 14, wherein a raised portion is formed in the recess of the connection block to retain and constrain the resilient member.

* * * * *